US007428489B2

(12) United States Patent
Touyama et al.

(10) Patent No.: US 7,428,489 B2
(45) Date of Patent: Sep. 23, 2008

(54) ENCODING METHOD AND APPARATUS, AND DECODING METHOD AND APPARATUS

(75) Inventors: Keisuke Touyama, Tokyo (JP); Shiro Suzuki, Kanagawa (JP); Minoru Tsuji, Chiba (JP)

(73) Assignee: Sony Corporation, Tokyo (JP)

( * ) Notice: Subject to any disclaimer, the term of this patent is extended or adjusted under 35 U.S.C. 154(b) by 681 days.

(21) Appl. No.: 10/483,088

(22) PCT Filed: Apr. 30, 2003

(86) PCT No.: PCT/JP03/05545

§ 371 (c)(1),
(2), (4) Date: Jan. 7, 2004

(87) PCT Pub. No.: WO03/096325

PCT Pub. Date: Nov. 20, 2003

(65) Prior Publication Data

US 2004/0196770 A1 Oct. 7, 2004

(30) Foreign Application Priority Data

May 7, 2002 (JP) ..... 2002-132188

(51) Int. Cl.
*G10L 19/00* (2006.01)
*G10L 19/14* (2006.01)
*G10L 21/00* (2006.01)

(52) U.S. Cl. ..... 704/225; 704/224; 704/500

(58) Field of Classification Search ..... 704/224, 704/225

See application file for complete search history.

(56) References Cited

U.S. PATENT DOCUMENTS

| | | | | |
|---|---|---|---|---|
| 5,185,800 | A * | 2/1993 | Mahieux | 704/500 |
| 5,563,913 | A * | 10/1996 | Akagiri et al. | 375/243 |
| 5,651,090 | A * | 7/1997 | Moriya et al. | 704/200.1 |
| 5,680,130 | A * | 10/1997 | Tsutsui et al. | 341/87 |
| 5,684,920 | A * | 11/1997 | Iwakami et al. | 704/203 |
| 5,684,923 | A * | 11/1997 | Suzuki et al. | 704/229 |
| 5,731,767 | A * | 3/1998 | Tsutsui et al. | 341/50 |
| 5,848,155 | A * | 12/1998 | Cox | 382/191 |
| 6,654,716 | B2 * | 11/2003 | Bruhn et al. | 704/219 |
| 2002/0054609 | A1 * | 5/2002 | Laurent | 370/478 |

FOREIGN PATENT DOCUMENTS

| | | |
|---|---|---|
| JP | 09-46233 | 2/1987 |
| JP | 04-116700 | 4/1992 |

(Continued)

*Primary Examiner*—David R. Hudspeth
*Assistant Examiner*—Justin W Rider
(74) *Attorney, Agent, or Firm*—Sonnenschein Nath & Rosenthal LLP

(57) ABSTRACT

In a decoding apparatus (30), power compensation spectrum generation/composition units (37$_1$ to 37$_4$) adjust power of power compensation spectrums PCSP based on quantization accuracy information, normalization coefficients, gain control information, and power adjustment information. Then, power of the spectrums SP is compensated by replacing spectrums SP being equal to or smaller than a threshold with the power-adjusted power compensation spectrums PCSP, or by adding the power-adjusted power compensation spectrums PCSP to the spectrums SP.

42 Claims, 9 Drawing Sheets

FOREIGN PATENT DOCUMENTS

| | | |
|---|---|---|
| JP | 06-202695 | 7/1994 |
| JP | 07-221649 | 8/1995 |
| JP | 08-223049 | 8/1996 |
| JP | 09-261064 | 10/1997 |
| JP | 11-85195 | 3/1999 |
| JP | 2001-249698 | 9/2001 |
| JP | 2002-372995 | 12/2002 |
| WO | WO 98/57436 | 12/1998 |
| WO | WO 00/45379 | 8/2000 |
| WO | WO 01/97212 | 12/2001 |
| WO | WO 02/41301 | 5/2002 |
| WO | WO 02/052732 | 7/2002 |
| WO | WO 02/103683 | 12/2002 |

* cited by examiner

FIG. 1 – PRIOR ART

FIG. 2 – PRIOR ART

ENCODING METHOD AND APPARATUS, AND DECODING METHOD AND APPARATUS

BACKGROUND OF THE INVENTION

The present invention relates to an encoding method and apparatus, a decoding method and apparatus, a program, and a recording medium, in particular, to an encoding method and apparatus for encoding digital data of acoustic signals or sound signals with high efficiency to transmit thus encoded data or record thus encoded data to a recording medium, to a decoding method and apparatus for receiving or reproducing encoded data to decode thus received or reproduced encoded data, to a program for making a computer carry out the encoding processing and the decoding processing, and to a recording medium having recorded therein the program which can be read out by a computer.

This application claims priority of Japanese Patent Application No. 2002-132188, filed on May 7, 2002, the entirety of which is incorporated by reference herein.

Conventionally, as methods for encoding audio signals of sound signals, etc. with high efficiency, there are known non-blocking frequency band division systems, such as the band division encoding (subband coding), and blocking frequency band division systems, such as the conversion encoding.

In the non-blocking frequency band division systems, an audio signal on time base are divided into a plurality of frequency bands without blocking the signal, and thus divided signal is encoded. On the other hand, in the blocking frequency band division systems, a signal on time base is converted to a signal on frequency base (spectrum conversion), and thus converted signal is divided into a plurality of frequency bands. Then, coefficients obtained through the spectrum conversion are put together according to predetermined respective frequency bands, and thus divided signal is encoded in respective bands.

Furthermore, as a method to improve efficiency of encoding, there is suggested a high-efficient encoding method which jointly introduces the non-blocking frequency band division system and the blocking frequency band division system. Employing this method, after performing band division employing band division encoding, a signal divided into respective bands is converted to a signal on frequency base through spectrum conversion, and thus converted signal is encoded in the respective bands.

In performing frequency band division, the QMF (Quadrature Mirror Filter) may be used in many cases since signals can be processed simply and aliasing distortions can be removed. Details of frequency band division by the QMF are written in "1976 R. E. Crochiere, Digital coding of speech in subbands, Bell Syst. Tech. J. Vol. 55, No. 8 1976".

Furthermore, as a method to perform band division, there is known the PQF (Polyphase Quadrature Filter) which is a filter division method with equalized bandwidths. Details of the PQF are written in "ICASSP 83 BOSTON, Polyphase Quadrature Filters—A new subband coding technique, Joseph H. Rothweiler".

On the other hand, as above-described spectrum conversion, for example, an input audio signal is blocked using a frame of predetermined unit time, and the signal on time base is converted to a signal on frequency base by undergoing the DFT (Discrete Fourier Transformation), DCT (Discrete Cosine Transformation), MDCT (Modified Discrete Cosine Transformation) in respective blocks.

Details of the MDCT are written in "ICASSP 1987, Subband/Transform Coding Using Filter Bank Designs Based on Time Domain Aliasing Cancellation, J. P. Prince, A. B. Bradley, Univ. of Surrey Royal Melbourne Inst. of Tech."

By quantizing a signal divided into respective bands which is obtained through the filter and spectrum conversion, bands which raise quantization noise can be controlled, which enables high-efficient encoding in auditory sense by utilizing property of masking effect, etc. Furthermore, prior to quantization, signal components of respective bands are normalized by the maximum of absolute values of signal components of each band, which enables more high-efficient encoding.

Bandwidths of respective frequency bands in performing band division are determined in view of human auditory property. That is, in general, an audio signal may be divided into a plurality of bands (for example, 32 bands) under critical bands in which higher bands are of broader bandwidth.

In encoding data in respective bands, bit allocation is performed to allocate predetermined bits or adaptable bits to respective bands. That is, in encoding coefficient data, obtained through the MDCT processing, by employing bit allocation, the numbers of bits are adaptably allocated to MDCT coefficient data of respective bands that are obtained by performing the MDCT processing for a signal blocked into respective blocks.

As bit allocation methods, there are known a method of performing bit allocation based on signal amount of respective bands (properly referred to as a first bit allocation method, hereinafter), and a method of performing bit allocation fixedly, in which signal-to-noise ratios necessary for respective bands are obtained by utilizing auditory masking (properly referred to as a second bit allocation method, hereinafter).

Details of the first bit allocation method are written in "Adaptive Transform Coding of Speech Signals, R. Zelinski and P. Noll, IEEE Transactions of Accoustics, Speech and Signal Processing, vol. ASSP-25, No. 4, August 1977".

Details of the second bit allocation method are written in "ICASSP 1980, The critical band coder digital encoding of the perceptual requirements of the auditory system, M. A. Kransner MIT".

Employing the first bit allocation method, quantization noise spectrums are planarized, minimizing noise energy. However, since masking effect is not utilized in auditory sense, actual auditory noise level is not optimized. On the other hand, employing the second bit allocation method, in case energy is concentrated on a specific frequency, for example, even though a sinusoidal wave is input, since bit allocation is performed fixedly, desirable property value cannot be obtained.

So, there is suggested a high-efficient encoding apparatus which divides entire bits, which are to be used in bit allocation, into bits for fixed bit allocation patterns which are determined in advance for respective small blocks and bits for bit allocation which depend on signal amount of respective blocks, and causes the division ration to depend on a signal related with an input signal. That is, for example, when spectrums of a signal are smooth, division proportion for the fixed bit allocation patterns is enhanced.

Employing this method, in case energy is concentrated on a specific spectrum when inputting a sinusoidal wave, many bits are allocated to a block including the spectrum, which can improve the whole signal-to-noise ratio significantly. In general, since human auditory is extremely sensitive to a signal having a steep spectrum component, above-described improvement of signal-to-noise ratio not only improves measurement numerical value but also improves quality of sound in auditory sense effectively.

As methods of bit allocation, there are suggested many other methods other than above-described methods, and models concerning auditory are becoming refined. Improvement in operational capability of an encoding apparatus enables high-efficient encoding from an auditory point of view.

In case of employing the DFT or the DCT as a method to convert a waveform signal to spectrums, when converting the signal using time blocks composed of M sets of samples, M sets of independent real number data can be obtained. Generally, in order to reduce connection distortions between time blocks (frames), each block is overlapped with both neighbouring blocks by predetermined M1 sets of samples respectively. Thus, when employing an encoding method utilizing the DFT or the DCT, M sets of real number data are quantized to be encoded for (M−M1) sets of samples on the average.

In case of employing the MDCT as a method to convert a signal on time base to spectrums, M sets of independent real number data can be obtained from 2M sets of samples with each block overlapped with both neighbouring blocks by M sets of samples respectively. Thus, in this case, M sets of real number data are quantized to be encoded for M sets of samples on the average. Then, a decoding apparatus regenerate a waveform signal from codes obtained in above-described method that utilizes the MDCT by adding waveform components obtained from respective blocks through inverse conversion with the respective waveform components interfering with each other.

In general, by making time blocks (frames) for conversion longer, frequency resolution of spectrums is enhanced and energy is concentrated on a specific spectrum component. In case of using the MDCT, in which a signal is converted using long blocks with each block overlapped with both neighbouring blocks by half and the number of obtained spectrums does not increase from the number of original time samples, it becomes possible to realize high-efficient encoding as compared with the case using the DFT or the DCT. Furthermore, by making adjacent blocks have properly long overlaps, distortions between blocks of a waveform signal can be reduced.

In generating an actual code sequence, firstly, quantization accuracy information indicative of a quantization step used to perform quantization and normalization coefficient information indicative of a coefficient used to normalize respective signal components are encoded with predetermined number of bits for respective bands in which normalization and quantization are to be performed. Then normalized and quantized spectrums are encoded.

There is written a high-efficient encoding method in "IDO/IEC 11172-3:1993(E), 1993", in which the numbers of bits indicative of quantization accuracy information are set to be different from band to band. According to the method, it is prescribed that higher bands are small in the number of bits indicative of quantization accuracy information.

FIG. 1 shows a block diagram of a conventional encoding apparatus 100 for encoding audio signals, etc. through frequency band division. A band division unit 101 receives an audio signal to be encoded, and divides thus received audio signal into, for example, four frequency-bands using filters of the QMF, PQF, etc. When dividing an audio signal into bands using the band division unit 101, widths of respective bands (properly referred to as encoding units, hereinafter) may be equal with each other or may not be equal according to critical bands. In this example, an audio signal is divided into four encoding units, while the number of the encoding units is not restricted to this number. Then, the band division unit 101 sends the audio signal, which is divided into four encoding units (properly referred to as first to fourth encoding units, hereinafter), to gain control units $\mathbf{102}_1$ to $\mathbf{102}_4$ corresponding to respective predetermined time blocks (frames).

The gain control units $\mathbf{102}_1$ to $\mathbf{102}_4$ generate gain control information according to amplitudes of respective signals in respective blocks, and control gains of the signals in the respective blocks based on the gain control information. Then, the gain control units $\mathbf{102}_1$ to $\mathbf{102}_4$ send signals of the first to fourth encoding units obtained through the gain control to spectrum conversion units $\mathbf{103}_1$ to $\mathbf{103}_4$, while sending the gain control information to a multiplexer 107.

The spectrum conversion units $\mathbf{103}_1$ to $\mathbf{103}_4$ perform spectrum conversion such as the MDCT for the gain-controlled signals on time base of the respective encoding units to generate signals on frequency base, and send thus generated signals on frequency base to normalization units $\mathbf{104}_1$ to $\mathbf{104}_4$ respectively as well as to a quantization accuracy decision unit 105.

The normalization units $\mathbf{104}_1$ to $\mathbf{104}_4$ extract signal components of maximum absolute value from respective signal components constituting the respective signals of the first to fourth encoding units, and set coefficients corresponding to thus extracted signal components to be normalization coefficients of the first to fourth encoding units. Then, the normalization units $\mathbf{104}_1$ to $\mathbf{104}_4$ normalize or divide the respective signal components constituting the respective signals of the first to fourth encoding units using values corresponding to the normalization coefficients of the first to fourth encoding units. Thus, in this case, normalized data obtained through the normalization ranges from −1.0 to 1.0. The normalization units $\mathbf{104}_1$ to $\mathbf{104}_4$ send normalized data of the first to fourth encoding units to quantization units $\mathbf{106}_1$ to $\mathbf{106}_4$ respectively, while sending the normalization coefficients of the first to fourth encoding units to the multiplexer 107.

The quantization accuracy decision unit 105 decides quantization steps to be used in quantizing the normalized data of the first to fourth encoding units based on the signals of the first to fourth encoding units sent from the gain control units $\mathbf{102}_1$ to $\mathbf{102}_4$. Then, the quantization accuracy decision unit 105 sends quantization accuracy information of the first to fourth encoding units corresponding to the quantization steps to the quantization units $\mathbf{106}_1$ to $\mathbf{106}_4$ as well as to the multiplexer 107.

The quantization units $\mathbf{106}_1$ to $\mathbf{106}_4$ encode the normalized data of the first to fourth encoding units by quantizing the data using the quantization steps corresponding to the quantization accuracy information of the first to fourth encoding units, and send thus obtained quantization coefficients of the first to fourth encoding units to the multiplexer 107.

The multiplexer 107 encodes the quantization coefficients, quantization accuracy information, normalization coefficients, and gain control information of the first to fourth encoding units, if necessary, to multiplex those data. Then, the multiplexer 107 transmits encoded data obtained through multiplex processing via a transmission line, or records the encoded data to a recording medium, not shown.

Instead of deciding quantization steps based on the signals obtained through band division, the quantization accuracy decision unit 105 can decide quantization steps based on normalization data, or can decide quantization steps in view of auditory phenomenon such as masking effect.

FIG. 2 shows a block diagram of a conventional decoding apparatus 120 for decoding encoded data output from the encoding apparatus 100. In the decoding apparatus 120 shown in FIG. 2, a demultiplexer 121 decodes and demultiplexes input encoded data into the quantization coefficients, quantization accuracy information, normalization coefficients, and gain control information of the first to fourth encoding units. Then, the demultiplexer 121 sends the quantization coefficients, quantization accuracy information, and normalization coefficients of the first to fourth encoding units to signal component construction units $\mathbf{122}_1$ to $\mathbf{122}_4$ corresponding to the respective encoding units, while sending the gain control information of the first to fourth encoding units to gain control units $\mathbf{124}_1$ to $\mathbf{124}_4$ corresponding to the respective encoding units.

The signal component construction unit $\mathbf{122}_1$ dequantizes the quantization coefficient of the first encoding unit using the quantization step corresponding to the quantization accuracy information of the first encoding unit to generate normalized data of the first encoding unit. Furthermore, the signal component construction unit $\mathbf{122}_1$ decodes the normalized data of the first encoding unit by multiplying the data by a value corresponding to the normalization coefficient of the first encoding unit, and sends thus obtained signal of the first encoding unit to a spectrum inverse-conversion unit $\mathbf{123}_1$.

The signal component construction units $\mathbf{122}_2$ to $\mathbf{122}_4$ perform similar decode processing to generate signals of the second to fourth encoding units, and send thus obtained signals of the second to fourth encoding units to spectrum inverse-conversion units $\mathbf{123}_2$ to $\mathbf{123}_4$ respectively.

The spectrum inverse-conversion units $\mathbf{123}_1$ to $\mathbf{123}_4$ perform spectrum inverse-conversion such as the IMDCT for the decoded signals on frequency base to generate signals on time base, and send thus generated signals on time base to gain control units $\mathbf{124}_1$ to $\mathbf{124}_4$.

The gain control units $\mathbf{124}_1$ to $\mathbf{124}_4$ perform gain control compensation processing based on gain control information sent from the demultiplexer 121, and send thus obtained signals of the first to fourth encoding units to a band composition unit 125.

The band composition unit 125 performs band composition to composite the signals of the first to fourth encoding units sent from the gain control units $\mathbf{124}_1$ to $\mathbf{124}_4$ to restore the original audio signal.

Since encoded data supplied or transmitted from the encoding apparatus 100 shown in FIG. 1 to the decoding apparatus 120 shown in FIG. 2 includes quantization accuracy information, auditory models used in the decoding apparatus 120 can be arbitrarily set up. That is, quantization steps for the respective encoding units can be freely set up in the encoding apparatus 100, which can improve sound quality and can enhance compression ratio without replacing or upgrading the decoding apparatus 120 along with improvement of operation capability of the encoding apparatus 100 and refinement of auditory models.

On the other hand, in this case, the number of bits to encode quantization accuracy information itself is caused to be undesirably large, which makes it difficult to improve the whole encoding efficiency from a level.

There is a method in which processing, for example, a decoding apparatus decides quantization accuracy information from normalization information instead of directly encoding quantization accuracy information. However, employing this method, the relation between normalization coefficients and quantization accuracy information is determined at the time the standard is decided, which makes it difficult to introduce control of quantization accuracy based on advanced auditory models in the future. Also, in case actual compression ratio has some width, the relation between normalization coefficients and quantization accuracy information has to be determined for respective values of compression ratio.

Thus, in order to improve compression ratio from a level, it is necessary to improve not only encoding efficiency of main information or direct subject for encoding such as audio signals shown in FIG. 1 but also encoding efficiency of secondary information which is not direct subject of encoding such as quantization accuracy information and normalization coefficients.

The inventor of the present invention suggested a method to improve encoding efficiency of secondary information in a specification and drawings of Japanese Patent Application No. 2000-390598 and Japanese Patent Application No. 2001-182383. Furthermore, the inventor of the present invention suggested a method to improve encoding efficiency of gain information in an encoding system that controls gains in a specification and drawings of Japanese Patent Application No. 2001-182093. According to those techniques, encoding efficiency of secondary information can be improved by employing variable codeword length coding utilizing various correlations, etc.

However, in case significantly high compression ratio is required, with the number of bits given to an encoding apparatus, quantization accuracy capable of preventing quantization noise from being perceived may not be maintained. In this case, the encoding apparatus often reduces bits allocated to main information. Specifically, normalized data (spectrum) is replaced with "0" or a small value, or band width to perform quantization is narrowed.

As a result, there is raised a problem that decoded and restored sound includes abnormal sound and noise due to temporal band variation, and lack of power due to replacement of spectrum with "0" or a small value. Especially, when compression ratio is significantly enhanced, those phenomenon are undesirably perceived noticeably, leading to an auditory problem.

SUMMARY OF THE INVENTION

Accordingly, the present invention has an object to overcome the above-mentioned drawbacks of the prior art by providing an encoding method and apparatus, a decoding method and apparatus for receiving or reproducing encoded data to decode thus received or reproduced encoded data, a program for making a computer carry out the encoding processing and the decoding processing, and a recording medium having recorded therein the program which can be read out by a computer, which can reduce abnormal sound and noise due to temporal band variation as well as lack of power caused when compression ratio is enhanced.

The above object can be attained by providing an encoding method for encoding spectrums that are generated from an input digital signal through spectrum conversion, including a power adjustment information generation step of generating power adjustment information to adjust power of power compensation spectrums which are to be composited with the spectrums at decoding side, and an encoding step of encoding the power adjustment information together with the spectrums.

In the power adjustment information generation step, the power adjustment information is generated based on tonality of the input digital signal.

In the encoding method, power adjustment information to adjust power of power compensation spectrums, which are to be composited with the spectrums at decoding side, is generated, and the power adjustment information is encoded together with the spectrums.

Also the above object can be attained by providing an encoding apparatus for encoding spectrums that are generated from an input digital signal through spectrum conversion, including power adjustment information generation means for generating power adjustment information to adjust power of power compensation spectrums which are to be composited with the spectrums at decoding side, and encoding means for encoding the power adjustment information together with the spectrums.

The power adjustment information generation means generates the power adjustment information based on tonality of the input digital signal.

In the encoding apparatus, power adjustment information to adjust power of power compensation spectrums, which are to be composited with the spectrums at decoding side, is generated, and the power adjustment information is encoded together with the spectrums.

Also the above object can be attained by providing a decoding method for decoding spectrums that are generated from a digital signal through spectrum conversion and encoding, including a decoding step of decoding the spectrums, a power compensation spectrum generation step of generating power compensation spectrums, and a composition step of compositing the decoded spectrums and the power compensation spectrums.

In the power compensation spectrum generation step, the power compensation spectrums are generated by referencing values of a table that is generated from a predetermined spectrum pattern. In referencing values of a table, a sequence of random numbers of such as Gaussian distribution may be used, or normalization information, quantization accuracy information, etc. used in encoding the spectrums may be used.

In the decoding method, power adjustment step of adjusting power of the power compensation spectrums may be included. In the power adjustment step, power of the power compensation spectrums is adjusted based on a normalization coefficient or quantization accuracy information that are used in decoding the spectrums, or power adjustment information that has been encoded in encoding the spectrums. In this case, in the composition step, the decoded spectrums and the power-adjusted power compensation spectrums are composited.

In the composition step, the spectrums and the power compensation spectrums are added, or at least a part of the spectrums are replaced with the power compensation spectrums.

In the decoding method, power of the power compensation spectrums is adjusted based on quantization accuracy information, a normalization coefficient, and power adjustment information, and the power-adjusted power compensation spectrums are composited with the decoded spectrums by adding the spectrums and the power compensation spectrums, or by replacing at least a part of the spectrums with the power compensation spectrums.

Also the above object can be attained by providing a decoding apparatus for decoding spectrums that are generated from a digital signal through spectrum conversion and encoding, including decoding means for decoding the spectrums, power compensation spectrum generation means for generating power compensation spectrums, and composition means for compositing the decoded spectrums and the power compensation spectrums.

The power compensation spectrum generation means generates the power compensation spectrums by referencing values of a table that is generated from a predetermined spectrum pattern. In referencing values of a table, a sequence of random numbers of such as Gaussian distribution may be used, or normalization information, quantization accuracy information, etc. used in encoding the spectrums may be used.

In the decoding apparatus, power adjustment means for adjusting power of the power compensation spectrums may be included. The power adjustment means adjusts power of the power compensation spectrums based on a normalization coefficient or quantization accuracy information that are used in decoding the spectrums, or power adjustment information that has been encoded in encoding the spectrums. In this case, the composition means composites the decoded spectrums and the power-adjusted power compensation spectrums.

The composition means adds the spectrums and the power compensation spectrums, or replaces at least a part of the spectrums with the power compensation spectrums.

The decoding apparatus adjusts power of the power compensation spectrums based on quantization accuracy information, a normalization coefficient, and power adjustment information, and composites the power-adjusted power compensation spectrums with the decoded spectrums by adding the spectrums and the power compensation spectrums, or by replacing at least a part of the spectrums with the power compensation spectrums.

Also the above object can be attained by providing a program for making a computer carry out above-described encoding processing and decoding processing, and a recording medium having recorded therein the program which can be read out by a computer.

These objects and other objects, features and advantages of the present invention will become more apparent from the following detailed description of the preferred embodiments of the present invention.

DETAILED DESCRIPTION OF THE PRESENTLY PREFERRED EMBODIMENTS

The present invention will further be described below concerning the best modes for carrying out the present invention with reference to the accompanying drawings. The present invention is adapted to the following embodiments of the encoding method and apparatus for encoding digital data of audio signals with high efficiency to transmit thus encoded data or record thus encoded data to a recording medium, and of the decoding method and apparatus for receiving or reproducing encoded data to decode thus received or reproduced encoded data.

Figure 1:
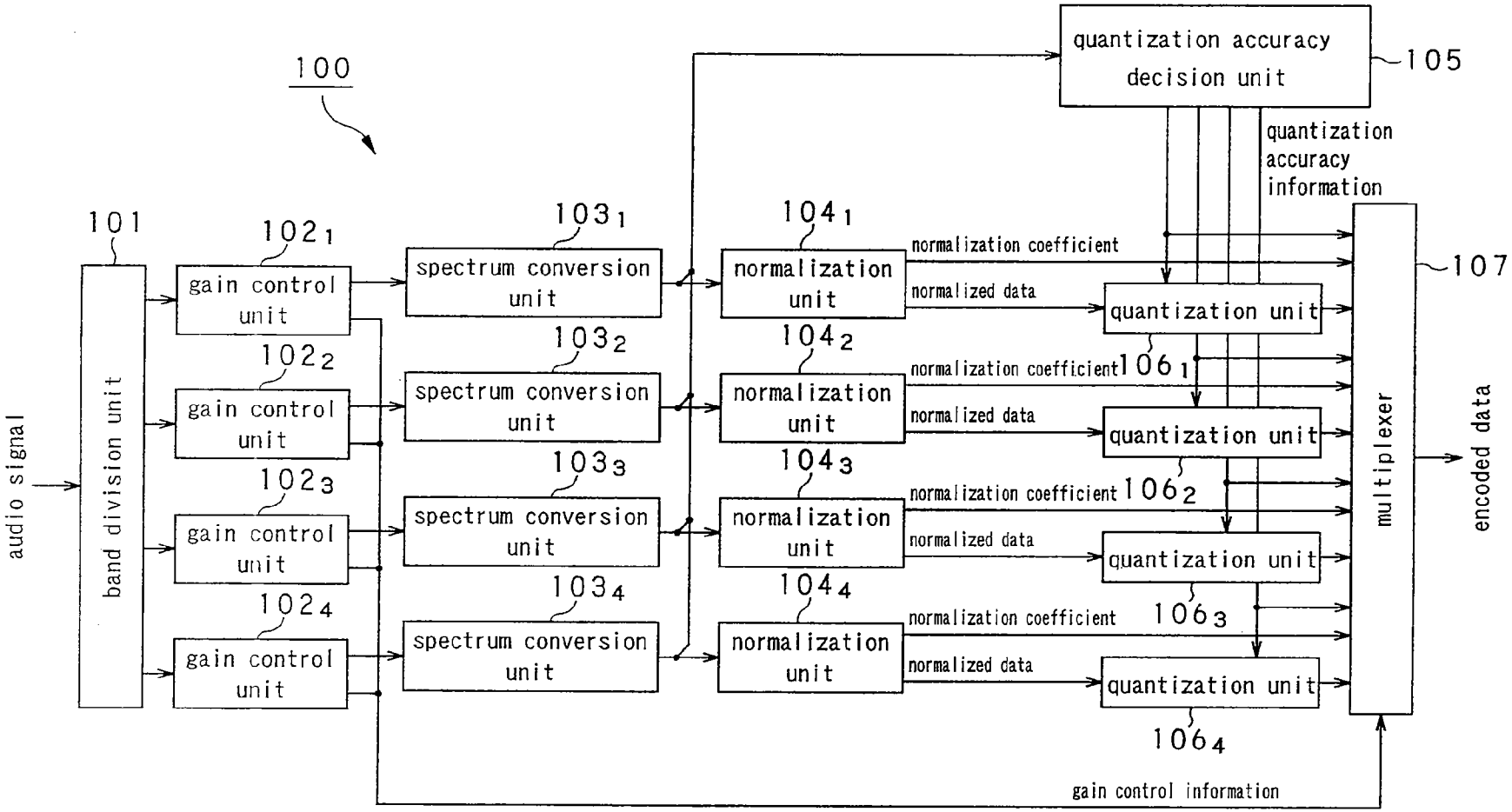
FIG. 1 shows a block diagram of a conventional encoding apparatus.
Figure 2:
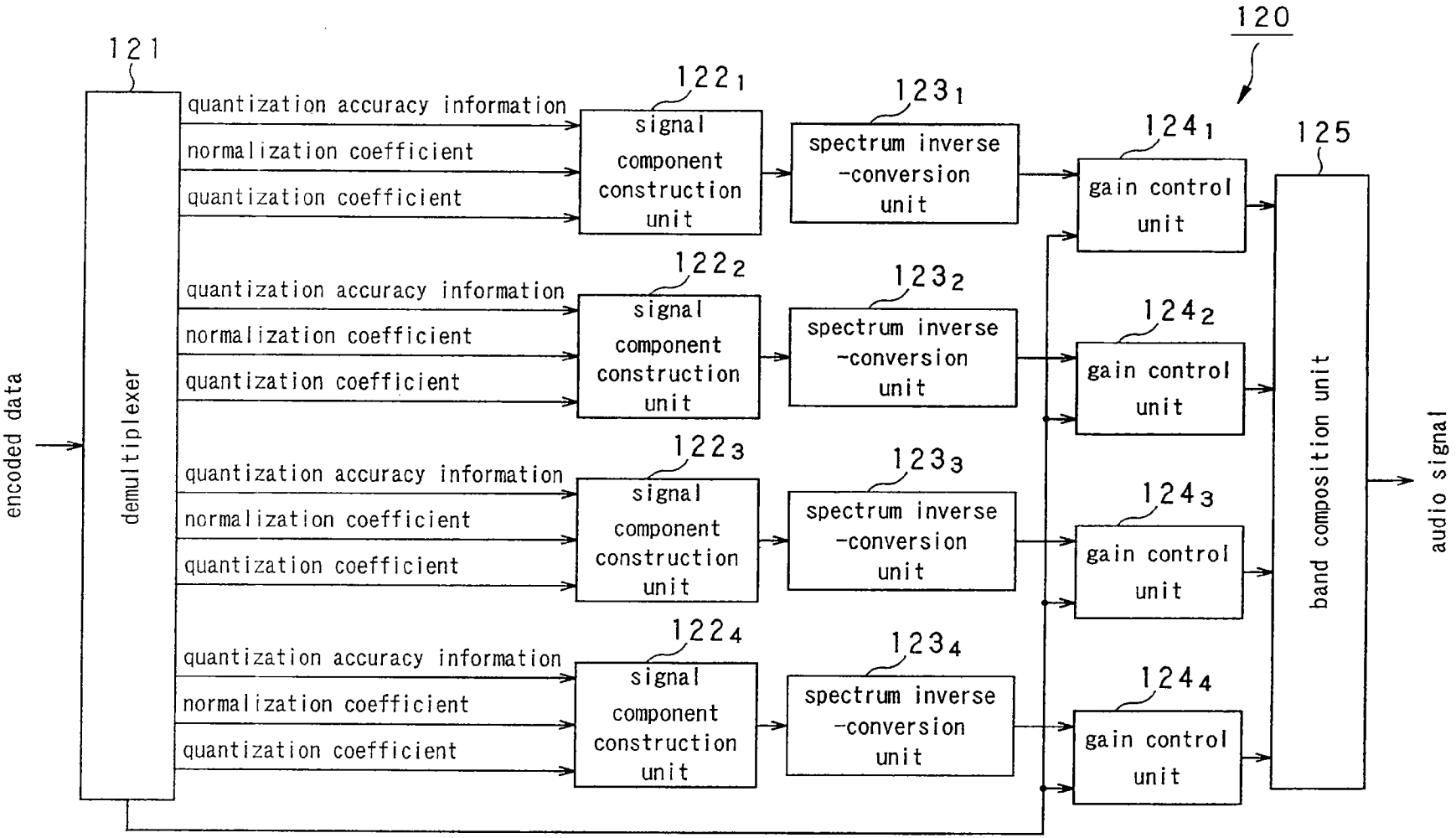
FIG. 2 shows a block diagram of a conventional decoding apparatus.
Figure 3:
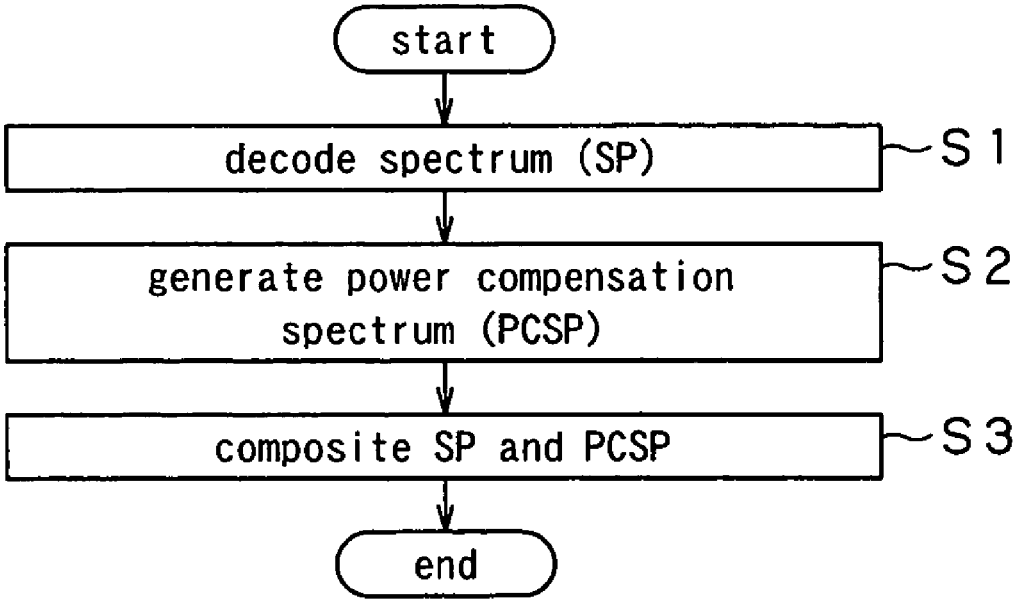
FIG. 3 shows a flow chart for explaining the fundamental concept of the present invention.

FIG. 3 shows a flow chart for explaining the fundamental concept of the present invention. Firstly, in step S1, a spectrum SP is decoded. The spectrum SP may include abnormal sound and noise due to temporal band variation that is caused by loss of spectrum when compression ratio is enhanced, and lack of power.

Then, in step S2, a power compensation spectrum PCSP is generated. Then, in step S3, the spectrum SP and the power compensation spectrum PCSP are composited to generate a composite spectrum signal.

That is, according to the encoding method and apparatus, decoding method and apparatus of the present invention, the power compensation spectrum PCSP is generated to be composited with the spectrum SP. As a result, in case compression ratio is enhanced, abnormal sound and noise due to temporal band variation as well as lack of power can be desirably removed.

Figure 4:
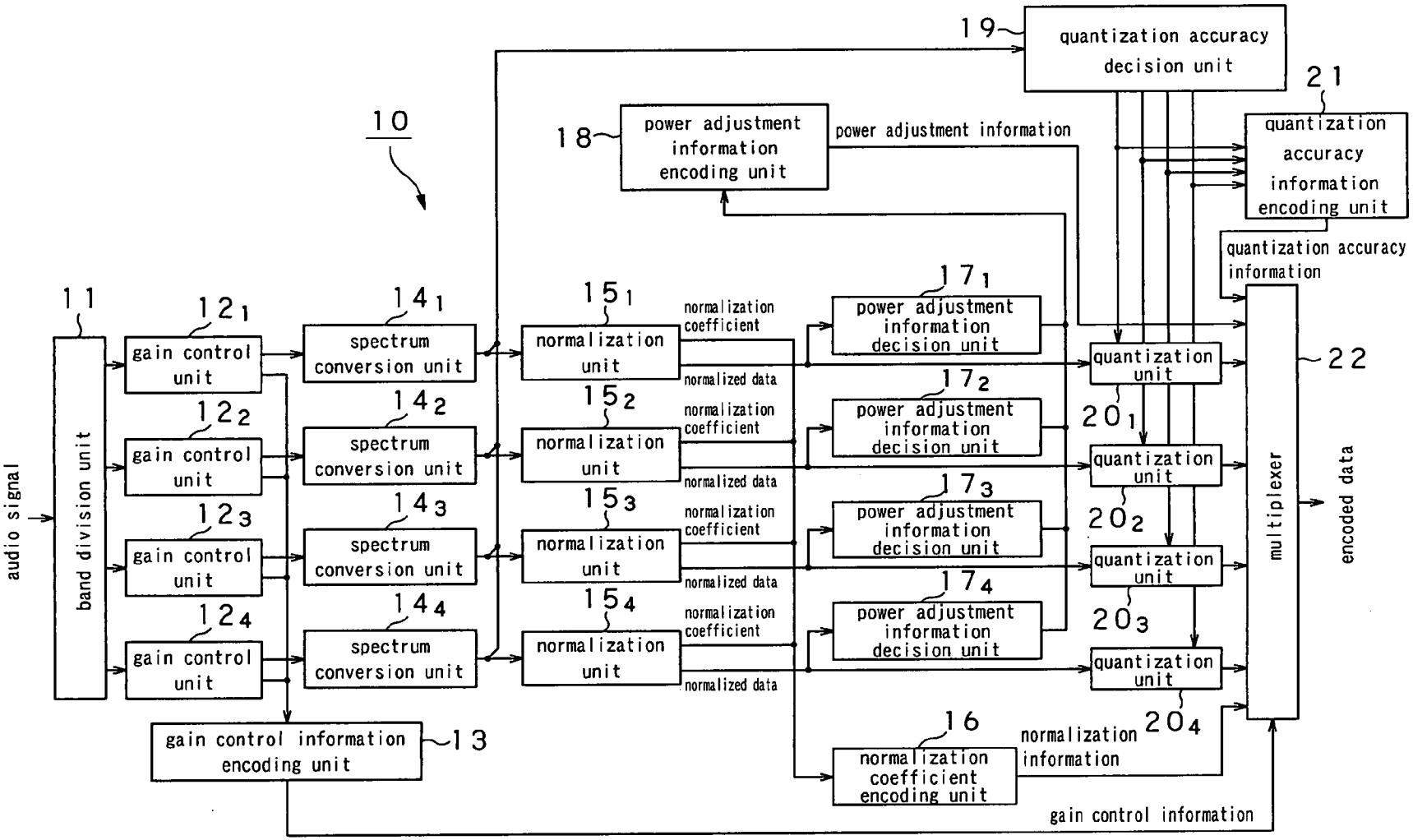
FIG. 4 shows a block diagram of an encoding apparatus according to the present invention.

FIG. 4 shows a block diagram of an encoding apparatus 10 according to the present invention. As shown in FIG. 4, a band division unit 11 receives an audio signal to be encoded, and divides thus received audio signal into, for example, four frequency-bands using filters of the QMF (Quadrature Mirror Filter), PQF (Polyphase Quadrature Filter), etc. When dividing an audio signal into bands using the band division unit 11, widths of respective bands (properly referred to as encoding units, hereinafter) may be equal with each other or may not be equal according to critical bands. In this embodiment, an audio signal is divided into four encoding units, while the number of the encoding units is not restricted to this number. Then, the band division unit 11 sends the audio signal, which is divided into four encoding units (properly referred to as first to fourth encoding units, hereinafter), to gain control units $\mathbf{12}_1$ to $\mathbf{12}_4$ corresponding to respective predetermined time blocks (frames).

The gain control units $\mathbf{12}_1$ to $\mathbf{12}_4$ generate gain control information according to amplitudes of respective signals in respective blocks, and control gains of the signals in the respective blocks based on the gain control information. Then, the gain control units $\mathbf{12}_1$ to $\mathbf{12}_4$ send signals of the first to fourth encoding units obtained through the gain control to spectrum conversion units $\mathbf{14}_1$ to $\mathbf{14}_4$, while sending the gain control information to a gain control information encoding unit 13.

The gain control information encoding unit 13 encodes the gain control information sent from the gain control units $\mathbf{12}_1$ to $\mathbf{12}_4$, and sends thus encoded data to a multiplexer 22. In encoding gain control information, the technique suggested in a specification and drawings of Japanese Patent Application No. 2001-182093 by the inventor of the present invention can be employed. That is, encoding efficiency of the gain control information can be improved by employing variable codeword length coding utilizing various correlations between neighbouring encoding units.

The spectrum conversion units $\mathbf{14}_1$ to $\mathbf{14}_4$ perform spectrum conversion such as the MDCT (Modified Discrete Cosine Transformation) for the signals on time base sent from the gain control units $\mathbf{12}_1$ to $\mathbf{12}_4$ to generate spectrums SP on frequency base, and send thus generated spectrums SP to normalization units $\mathbf{15}_1$ to $\mathbf{15}_4$ respectively as well as to a quantization accuracy decision unit 19.

The normalization units $\mathbf{15}_1$ to $\mathbf{15}_4$ extract signal components of maximum absolute value from respective signal components constituting the respective spectrums SP of the first to fourth encoding units, and set coefficients corresponding to thus extracted signal components to be normalization coefficients of the first to fourth encoding units. Then, the normalization units $\mathbf{15}_1$ to $\mathbf{15}_4$ normalize or divide the respective signal components constituting the respective spectrums SP of the first to fourth encoding units using values corresponding to the normalization coefficients of the first to fourth encoding units. Thus, in this case, normalized data obtained through the normalization ranges from −1.0 to 1.0. The normalization units $\mathbf{15}_1$ to $\mathbf{15}_4$ send normalized data of the first to fourth encoding units to power adjustment information decision units $\mathbf{17}_1$ to $\mathbf{17}_4$ as well as to quantization units $\mathbf{20}_1$ to $\mathbf{20}_4$ respectively, while sending the normalization coefficients of the first to fourth encoding units to a normalization coefficient encoding unit 16.

The normalization coefficient encoding unit 16 encodes the normalization coefficients sent from the normalization units $\mathbf{15}_1$ to $\mathbf{15}_4$, and sends thus encoded data to the multiplexer 22. In encoding normalization coefficients, the technique suggested in a specification and drawings of Japanese Patent Application No. 2000-390589 and Japanese Patent Application No. 2001-182093 by the inventor of the present invention can be employed. That is, encoding efficiency of normalization coefficients can be improved by employing variable codeword length coding utilizing various correlations between neighbouring encoding units, between neighbouring channels, between neighbouring time periods, etc., or by quantizing rough sketch information and performing variable codeword length coding for resultant quantization errors.

Power adjustment information decision units $\mathbf{17}_1$ to $\mathbf{17}_4$ decide power adjustment information, to be described later, to adjust power of the power compensation spectrums PCSP at decoding side. In case there exist missing parts in a spectrum or parts where the value is set to be "0" in the original sound state, when the spectrum SP is composited with the power compensation spectrum PCSP at decoding side, spectrum undesirably occurs at parts where there exists no spectrum originally. Especially, in case of a signal of tone type, it is desired that compensation amount by the power compensation spectrum PCSP be small.

In case there exist missing parts in a spectrum or parts where the value is set to be "0" in the original sound state such as a signal of tone type whose tonality is higher than a predetermined value, the power compensation spectrum PCSP is suppressed to be a small value or set to be "0". On the other hand, in case spectrum of the original sound is of noise type such as a signal of noise type whose tonality is lower than a predetermined value, the power compensation spectrum PCSP is enlarged to be a large value. Thus, the power adjustment information is decided based on tonality of an input signal, and power of the power compensation spectrum PCSP is controlled at encoding side.

There are various control methods and control widths for the power compensation spectrum PCSP using power adjustment information. In case power adjustment information is expressed by "1" bit, power of the power compensation spectrum PCSP can be controlled in such a manner that power is not controlled in case of a tone type signal, and power is controlled in case of a noise type signal. On the other hand, in case power adjustment information is expressed by 4 bits, power of the power compensation spectrum PCSP can be controlled in such a manner that power of the power compensation spectrum PCSP is set to be "0" in case the power adjustment information is "0", and power of the power compensation spectrum PCSP is adjusted over 15 dB width with "1" dB step pitch in case the power adjustment information is other than "0".

A power adjustment information encoding unit 18 encodes the power adjustment information sent from the power adjustment information decision units $\mathbf{17}_1$ to $\mathbf{17}_4$, and sends thus encoded data to the multiplexer 22. Since generation and composition of the power compensation spectrum PCSP is performed in respective encoding units, as will be described later, the power adjustment information may be encoded in respective encoding units. On the other hand, the power adjustment information may be encoded in respective grouped bands in which a plurality of encoding units are put together. This is based on the fact that, in general, tonality of a signal does not vary so much within narrow bands, and tonality of the same value can be shared within gathered bands in many cases.

Since human auditory is sensitive to a signal of low frequency, it is desired that power compensation amount of the spectrum SP by the power compensation spectrum PCSP be minimized or power compensation not be performed at all at low frequency bands (for example, 350 Hz or lower). In case power compensation of the spectrum SP by the power compensation spectrum PCSP is not performed at frequency bands that are lower than a predetermined frequency, it is not necessary to encode power adjustment information corresponding to the bands.

The quantization accuracy decision unit 19 decides quantization steps to be used in quantizing the normalized data of the first to fourth encoding units based on the spectrums SP of the first to fourth encoding units sent from the spectrum conversion units $\mathbf{14}_1$ to $\mathbf{14}_4$. Then, the quantization accuracy decision unit 19 sends quantization accuracy information of the first to fourth encoding units corresponding to the quantization steps to the quantization units $\mathbf{20}_1$ to $\mathbf{20}_4$ as well as to the quantization accuracy information encoding unit 21.

The quantization units $\mathbf{20}_1$ to $\mathbf{20}_4$ encode the normalized data of the first to fourth encoding units by quantizing the data using the quantization steps corresponding to the quantization accuracy information of the first to fourth encoding units, and send thus obtained quantization coefficients of the first to fourth encoding units to the multiplexer 22.

The quantization accuracy information encoding unit 21 encodes quantization accuracy information sent from the quantization accuracy decision unit 19, and sends thus encoded data to the multiplexer 22. Also, in encoding quantization accuracy information, the technique suggested in a specification and drawings of Japanese Patent Application No. 2000-390589 and Japanese Patent Application No. 2001-182093 can be employed.

The multiplexer 22 multiplexes the quantization coefficients of the first to fourth encoding units together with the gain control information, quantization accuracy information, normalization information, and power adjustment information. Then, the multiplexer 22 transmits encoded data obtained through multiplex processing via a transmission line, or records the encoded data to a recording medium, not shown.

As has been described above, the encoding apparatus 10 according to the present invention generates power adjustment information to adjust power of the power compensation spectrums PCSP, which are to be composited with the spectrums SP at decoding side, and encodes the power adjustment information together with the spectrums SP, and then transmits thus encoded data via a transmission line, or records the encoded data to a recording medium, not shown.

Figure 5:
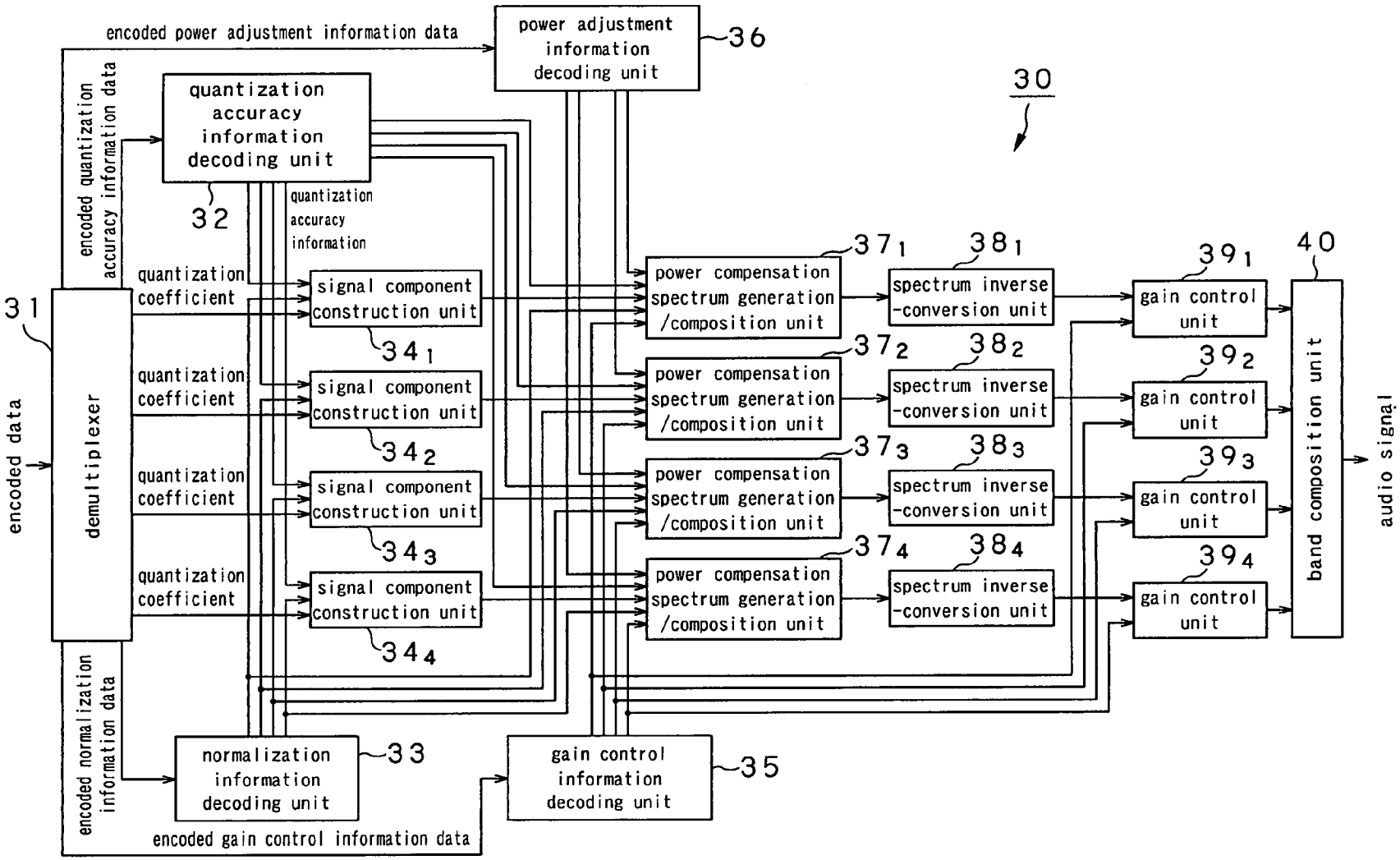
FIG. 5 shows a block diagram of a decoding apparatus according to the present invention.

FIG. 5 shows a block diagram of a decoding apparatus 30 according to the present invention for decoding encoded data output from the encoding apparatus 10. In the decoding apparatus 30 shown in FIG. 5, a demultiplexer 31 decodes and demultiplexes input encoded data into the quantization coefficients, encoded quantization accuracy information data, encoded normalization information data, encoded gain control information data, and encoded power adjustment information data of the first to fourth encoding units. Then, the demultiplexer 31 sends the quantization coefficients of the first to fourth encoding units to signal component construction units $\mathbf{34}_2$ to $\mathbf{34}_4$ corresponding to the respective encoding units. Also, the demultiplexer 31 sends the encoded quantization accuracy information data, encoded normalization information data, encoded gain control information data, and encoded power adjustment information data of the first to fourth encoding units to a quantization accuracy information decoding unit 32, a normalization information decoding unit 33, a gain control information decoding unit 35, and a power adjustment information decoding unit 36, respectively.

The quantization accuracy information decoding unit 32 decodes the encoded quantization accuracy information data, and sends thus decoded quantization accuracy information to the signal component construction units $\mathbf{34}_1$ to $\mathbf{34}_4$ as well as to power compensation spectrum generation/composition units $\mathbf{37}_1$ to $\mathbf{37}_4$ corresponding to the respective encoding units.

The normalization information decoding unit 33 decodes the encoded normalization information data, and sends thus decoded normalization coefficients to the signal component construction units $\mathbf{34}_1$ to $\mathbf{34}_4$ as well as to the power compensation spectrum generation/composition units $\mathbf{37}_1$ to $\mathbf{37}_4$ corresponding to the respective encoding units.

The signal component construction unit $\mathbf{34}_1$ dequantizes the quantization coefficient of the first encoding unit using the quantization step corresponding to the quantization accuracy information of the first encoding unit to generate normalized data of the first encoding unit. Furthermore, the signal component construction unit $\mathbf{34}_1$ decodes the normalized data of the first encoding unit by multiplying the data by a value corresponding to the normalization information of the first encoding unit, and sends thus obtained spectrum SP of the first encoding unit to the power compensation spectrum generation/composition unit $\mathbf{37}_1$.

The signal component construction units $\mathbf{34}_2$ to $\mathbf{34}_4$ perform similar decode processing to generate spectrums SP of the second to fourth encoding units, and send thus obtained spectrums SP of the second to fourth encoding units to the power compensation spectrum generation/composition units $\mathbf{37}_2$ to $\mathbf{37}_4$ respectively.

The gain control information decoding unit 35 decodes encoded gain control information data, and sends thus decoded gain control information to the power compensation spectrum generation/composition units $\mathbf{37}_1$ to $\mathbf{37}_4$ as well as to gain control units $\mathbf{39}_1$ to $\mathbf{39}_4$ corresponding to the respective encoding units.

The power adjustment information decoding unit 36 decodes encoded power adjustment information data, and sends thus decoded power adjustment information to the power compensation spectrum generation/composition units $\mathbf{37}_1$ to $\mathbf{37}_4$ corresponding to the respective encoding units.

The power compensation spectrum generation/composition units $\mathbf{37}_1$ to $\mathbf{37}_4$ generate the power compensation spectrums PCSP, and adjust power of the power compensation spectrums PCSP based on the quantization accuracy information, normalization coefficients, gain control information, and power adjustment information. Then, the power compensation spectrum generation/composition units $37_1$ to $37_4$ composite the power-adjusted power compensation spectrums PCSP with the spectrums SP to compensate power of the spectrums SP. The method of generating the power compensation spectrums PCSP and of compositing the power compensation spectrums PCSP and the spectrums SP will be explained later.

The spectrum inverse-conversion units $38_1$ to $38_4$ perform spectrum inverse-conversion such as the IMDCT (Inverse MDCT) for the compensated spectrums SP sent from the power compensation spectrum generation/composition units $37_1$ to $37_4$ to generate signals on time base, and send thus generated signals on time base to the gain control units $39_1$ to $39_4$.

The gain control units $39_1$ to $39_4$ perform gain control compensation processing for the signals of the first to fourth encoding units based on the gain control information sent from the gain control information decoding unit 35, and send thus obtained signals of the first to fourth encoding units to a band composition unit 40.

The band composition unit 40 performs band composition to composite the signals of the first to fourth encoding units sent from the gain control units $39_1$ to $39_4$ to restore the original audio signal.

As has been described above, the decoding apparatus 30 according to the present invention adjusts power of the power compensation spectrums PCSP based on the quantization accuracy information, normalization coefficients, gain control information, and power adjustment information, which are included in encoded data, and then composites the power-adjusted power compensation spectrums PCSP with the spectrums SP. Thus, even though compression ratio is enhanced, abnormal sound and noise due to temporal band variation as well as lack of power can be significantly reduced.

Figure 6:
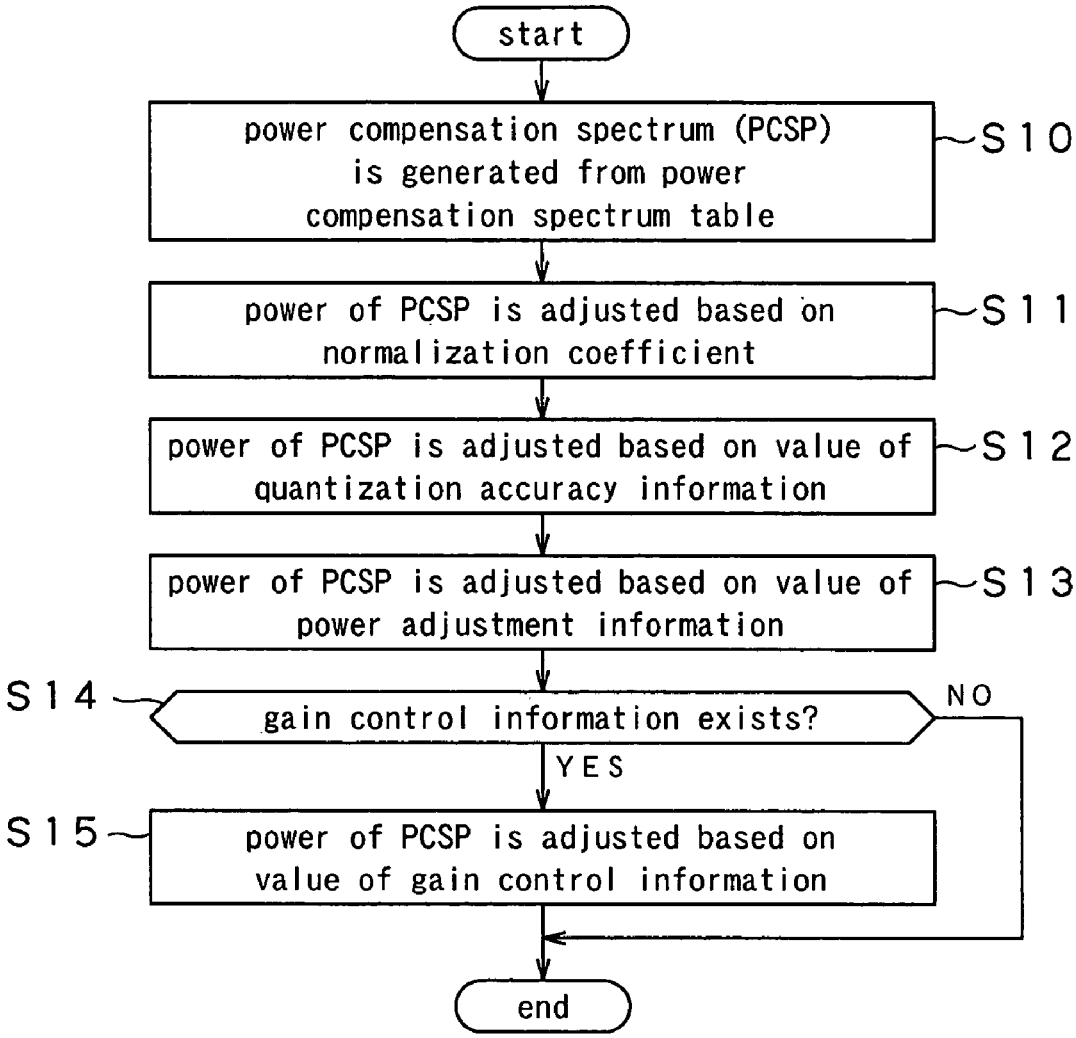
FIG. 6 shows a flow chart for explaining an example of the processing of generating the power compensation spectrum PCSP and power adjustment for the power compensation spectrum PCSP using the decoding apparatus.

FIG. 6 shows a flow chart for explaining an example of the processing of generating the power compensation spectrum PCSP and power adjustment for the power compensation spectrum PCSP. Firstly, in step S10, a power compensation spectrum PCSP is generated from a power compensation spectrum table.

The power compensation spectrum table may be a sequence of random numbers of such as Gaussian distribution, or a sequence of numbers prepared through learning using actual various noise type spectrums, etc. The power compensation spectrum table is not restricted to one, and may be selected from plural power compensation spectrum tables that are prepared in advance.

When generating the power compensation spectrum PCSP, values corresponding to the number of spectrums in an encoding unit are referenced from the power compensation spectrum table. In this case, since referencing the same point of the table consecutively in time may cause adverse affect on auditory sense, values are selected at random in time. Specifically, values may be selected at random using a random creation function. On the other hand, so as to prevent generation of the same power compensation spectrum PCSP every time, it is desired that values be selected at random using other parameters enabling random state in time such as normalization coefficients, quantization accuracy information, etc. Thus, the same power compensation spectrum PCSP can be obtained from the same code sequence irrespective of a decoding apparatus.

In the following explanation, as an example of such parameters, a value adding entire index values of normalization coefficients will be used. When the size of a power compensation spectrum table is 1024 and in case an added value of index values of normalization coefficients exceeds 1024, lower 10 bit values thereof are used.

Also, in case the number of spectrums in an encoding unit is 16, not referencing the same reference point in respective encoding units, in the following encoding unit, a point that is shifted by 16 from an initially referenced point should be referenced, preventing the same point from being referenced consecutively.

Then, in step S11, power of the power compensation spectrum PCSP is adjusted based on the normalization coefficient. Specifically, the maximum power value of the power compensation spectrum PCSP is adjusted to be the normalization coefficient.

Then, in step S12, power of the power compensation spectrum PCSP is adjusted based on a value of quantization accuracy information. In this processing, power of the power compensation spectrum PCSP is adjusted so that compensation by the power compensation spectrum PCSP is scarcely performed in case quantization accuracy is high, while compensation by the power compensation spectrum PCSP is actively performed in case quantization accuracy is low. Specifically, the power compensation spectrum PCSP may be divided by a value of quantization accuracy information, or may be divided by the quantization-accuracy-information-value power of 2.

Then, in step S13, power of the power compensation spectrum PCSP is adjusted based on a value of power adjustment information. This processing is to prevent spectrum, which is generated by compositing the power compensation spectrum PCSP in case there exist missing parts in a spectrum and encoding is not performed or parts where the value is set to be "0" in the original sound state, from occurring at part where there exists no spectrum originally.

Then, in step S14, it is judged whether there exists gain control information or not. In step S14, in case there exists gain control information (Yes), the processing goes to step S15, while in case there exists no gain control information (No), the processing of generating the power compensation spectrum PCSP and power adjustment for the power compensation spectrum PCSP comes to an end.

Then, in step S15, power of the power compensation spectrum PCSP is adjusted based on a value of the gain control information. This processing is to prevent excessiveness of power compensation amount by the power compensation spectrum PCSP, which is caused when, in case gain of a spectrum is lifted under gain control, gain of the power compensation spectrum PCSP components is concurrently lifted. Specifically, for example, the power compensation spectrum PCSP is divided by the maximum value of the gain control information.

Thus, the processing of generating the power compensation spectrum PCSP and power adjustment for the power compensation spectrum PCSP is performed. In this processing, values which are encoded for the spectrum SP are used for the normalization coefficient, quantization accuracy information, and gain control information, and it is not necessary to especially encode other normalization coefficients, etc. for the power compensation spectrum PCSP.

Figure 7:
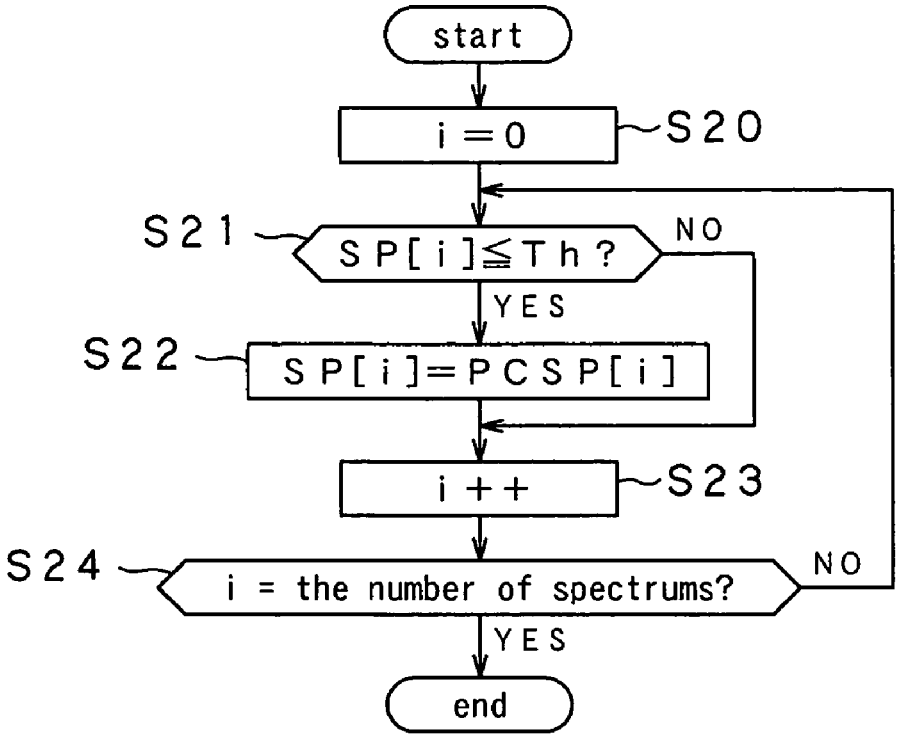
FIG. 7 shows a flow chart for explaining an example of the processing of compositing the spectrum SP and the power compensation spectrum PCSP.

Then, thus power-adjusted power compensation spectrum PCSP is composited with the spectrum SP. FIG. 7 shows a flow chart for explaining an example of the processing of compositing the spectrum SP and the power compensation spectrum PCSP. Firstly, in step S20, the value "i" of counter showing the number of spectrums is reset to be "0".

Then, in step S21, it is judged whether the "i"th spectrum SP[i] is equal to or smaller than a threshold "Th". In step S21, in case the spectrum SP[i] is equal to or smaller than the threshold "Th" (Yes), the processing goes to step S22, while in case the spectrum SP[i] is larger than the threshold "Th" (No), the processing goes to step S23.

In step S22, the spectrum SP[i] is replaced with the "i"th power compensation spectrum PCSP[i], and the processing goes to step S23.

In step S23, the value "i" of counter is increased by "1" to proceed to the next spectrum.

Then, in step S24, it is judged whether the value "i" of counter reaches the number of spectrums in an encoding unit. In step S24, in case the value "i" of counter reaches the number of spectrums in the encoding unit (Yes), the composition processing comes to an end. On the other hand, in case the value "i" of counter does not reach the number of spectrums in the encoding unit (No), the processing returns to step S21, keeping on the composition processing.

Thus, the spectrum SP and the power compensation spectrum PCSP are composited by replacing the spectrum SP being equal to or smaller than the threshold "Th" with the power compensation spectrum PCSP.

The processing of compositing the spectrum SP and the power compensation spectrum PCSP is not restricted to this example. There may be another example in which processing, a threshold "Th" is set to be "0", and the spectrum SP is replaced with the power compensation spectrum PCSP only in case the spectrum SP is "0".

Figure 8:
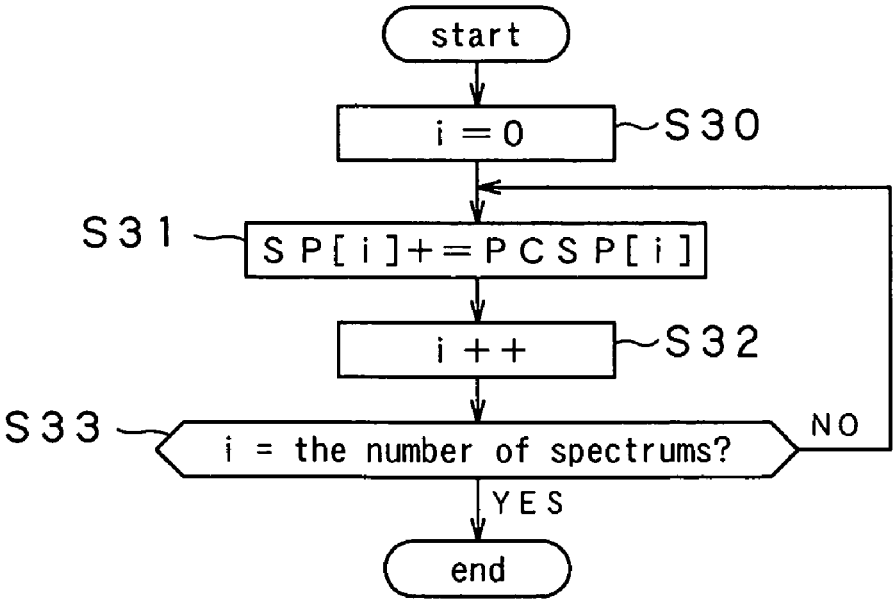
FIG. 8 shows a flow chart for explaining another example of the processing of compositing the spectrum SP and the power compensation spectrum PCSP.

Furthermore, there may be yet another example in which processing, a threshold "Th" is not settled, and the entire spectrum signals SP have the power compensation spectrums PCSP added thereto. FIG. 8 shows a flow chart for explaining an example of the processing of adding the power compensation spectrums PCSP to the entire spectrum signals SP. Firstly, in step S30, the value "i" of counter showing the number of spectrums is reset to be "0".

Then, in step S31, the power compensation spectrum PCSP [i] is added to the spectrum SP[i]. Then, in step S32, the value "i" of counter is increased by "1".

Then, in step S33, it is judged whether the value "i" of counter reaches the number of spectrums in an encoding unit. In step S33, in case the value "i" of counter reaches the number of spectrums in the encoding unit (Yes), the composition processing comes to an end. On the other hand, in case the value "i" of counter does not reach the number of spectrums in the encoding unit (No), the processing returns to step S31, keeping on the composition processing.

Figure 9:
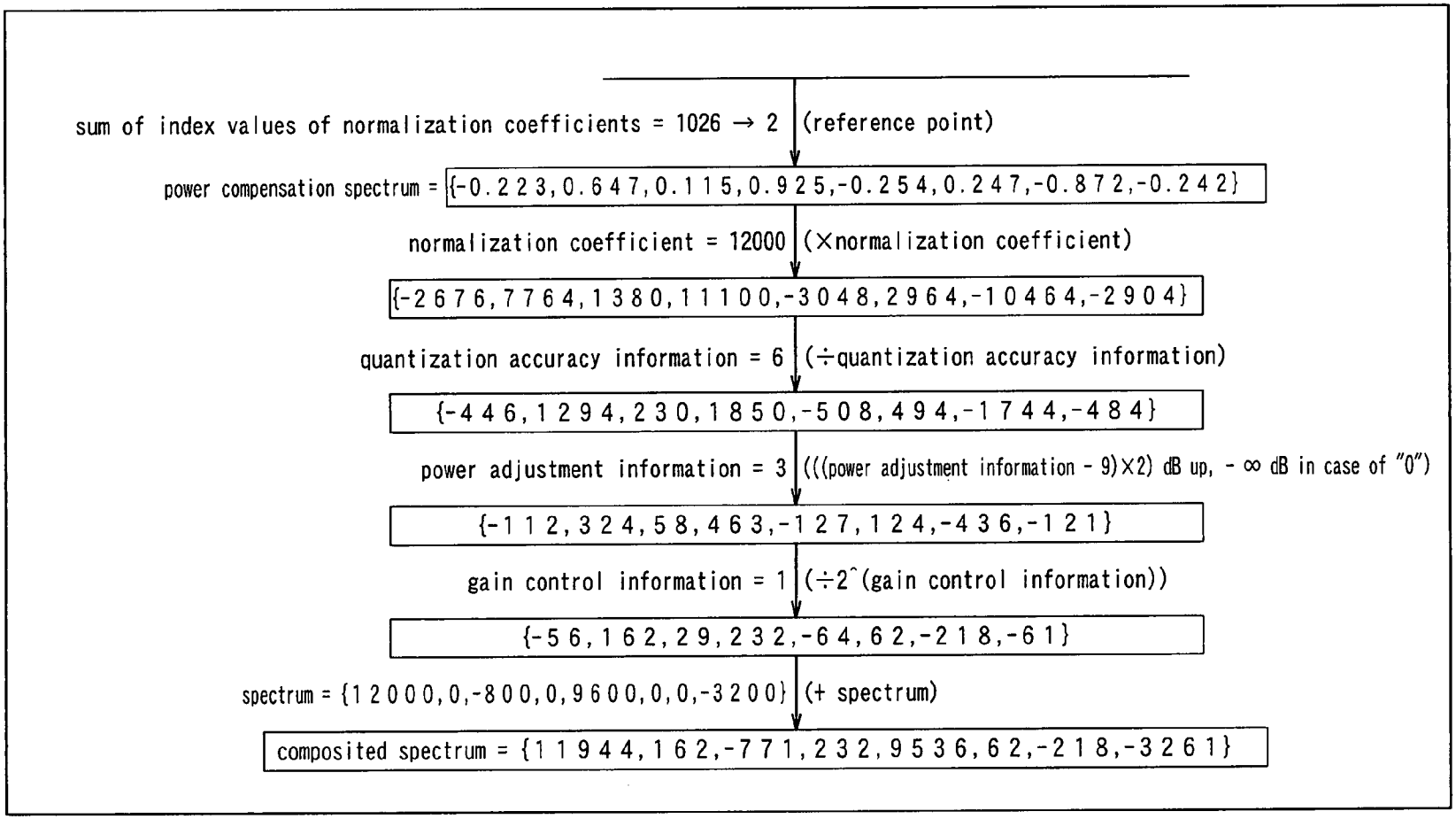
FIG. 9 shows a view for explaining a specific example of the processing of generating the power compensation spectrum PCSP and power adjustment for the power compensation spectrum PCSP, and of compositing the spectrum SP and the power compensation spectrum PCSP.

FIG. 9 shows a view for explaining a specific example of the processing of generating the power compensation spectrum PCSP and power adjustment for the power compensation spectrum PCSP, and of compositing the spectrum SP and the power compensation spectrum PCSP. In this specific example, it is assumed that the number of entry of the power compensation spectrum table is 1024, while the number of spectrums in an encoding unit is 8. In FIG. 9, the processing of adding the power compensation spectrums PCSP to the entire spectrum signals SP shown in FIG. 8 is employed.

The point for referencing the power compensation spectrum table is detected from an added value of index values of normalization coefficients. Even though the sum of index values of normalization coefficients is 1026 in this example, since the number of entry of the power compensation spectrum table is 1024, lower 10 bit values thereof are used. That is, the value of the reference point is 2. Thus, eight values of from third to tenth values of the power compensation spectrum table are selected, and values of the power compensation spectrum PCSP become {−0.223, 0.647, 0.115, 0.925, −0.254, 0.247, −0.872, −0.242}.

Next, power of the power compensation spectrum PCSP is adjusted based on the normalization coefficient. Specifically, the power is adjusted by multiplying the values of the power compensation spectrum PCSP by the normalization coefficient. Since the normalization coefficient is 12000, the values of the power compensation spectrum PCSP become {−2676, 7764, 1380, 11100, −3048, 2964, −10464, −2904}.

Next, power of the power compensation spectrum PCSP is adjusted based on a value of the quantization accuracy information. Specifically, the power is adjusted by dividing the values of power compensation spectrum PCSP by the value of the quantization accuracy information. Since the value of the quantization accuracy information is 6, the values of the power compensation spectrum PCSP become {−446, 1294, 230, 1850, −508, 494, −1744, −484}.

Next, power of the power compensation spectrum PCSP is adjusted based on a value of the power adjustment information. Specifically, the power is adjusted by lifting the values of the power compensation spectrum PCSP by ((power adjustment information value −9)×2) dB. In case the value of the power adjustment information is "0", the lift value is −∞ dB, since the value of the power adjustment information is 3, operation of lifting by −12 dB is performed, and the values of the power compensation spectrum PCSP become {−112, 324, 58, 463, −127, 124, −436, −121}.

Next, power of the power compensation spectrum PCSP is adjusted based on a value of the gain control information. Specifically, the power is adjusted by dividing the values of the power compensation spectrum PCSP by the gain-control-information-value power of 2. Since the value of the gain control information is 3, operation of division by 2 is performed, and the values of the power compensation spectrum PCSP become {−56, 162, 29, 232, −64, 62, −218, −61}.

Then, a final composited spectrum can be obtained by adding thus generated power compensation spectrum PCSP to the spectrum SP. Since values of the spectrum SP are {12000, 0, −800, 0, 9600, 0, 0, −3200}, by adding the generated values of the power compensation spectrum PCSP to the values of the spectrum SP, a composited spectrum whose values are {11944, 162, −771, 232, 9536, 62, −218, −3261} can be obtained.

Figure 10A:
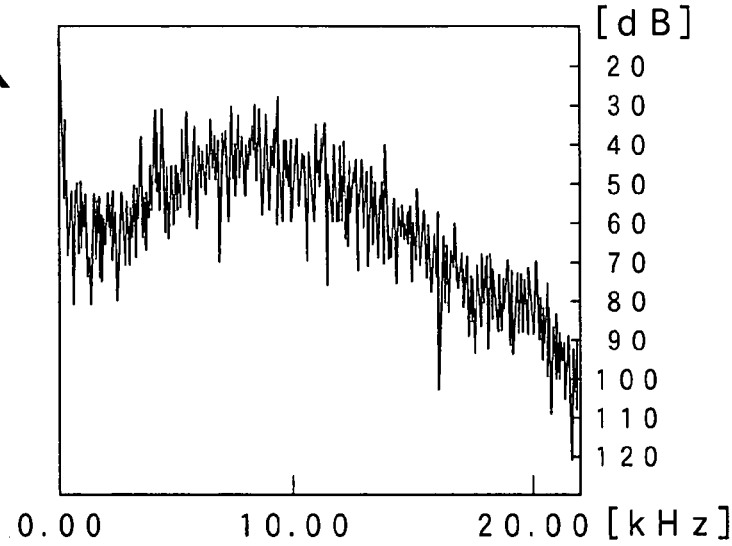
FIG. 10A shows a spectrum of the original sound.
Figure 10B:
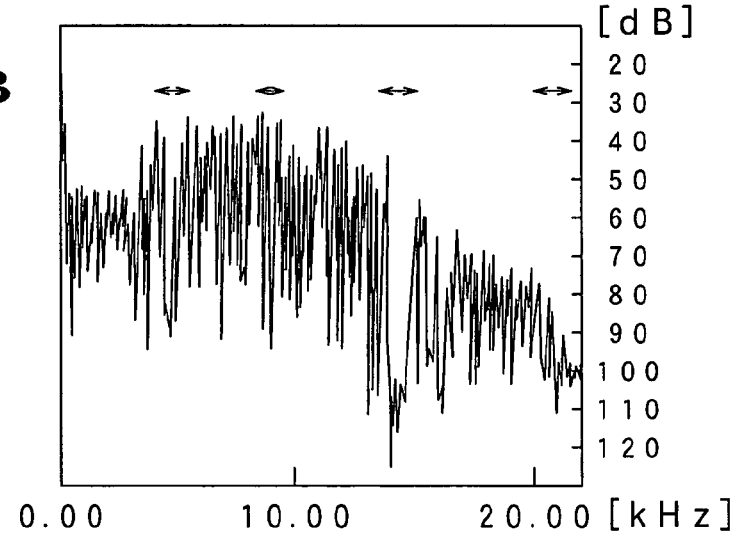
FIG. 10B shows a spectrum after undergoing the conventional encoding processing.
Figure 10C:
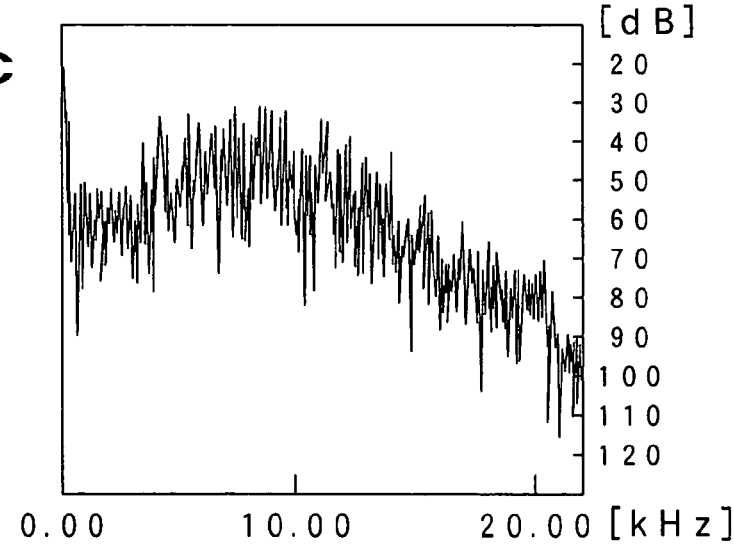
FIG. 10C shows a spectrum after undergoing the composition processing employing the present invention using the power compensation spectrum PCSP.

FIGS. 10A to 10C show views of actual spectrums. FIG. 10A shows a spectrum of the original sound, FIG. 10B shows a spectrum after undergoing the conventional encoding processing, FIG. 10C shows a spectrum after undergoing the composition processing employing the present invention using the power compensation spectrum PCSP. From the views, there exist missing parts in the spectrum, which correspond to arrows, as shown in FIG. 10B, while these parts are composited with the power compensation spectrum PCSP to suppress lack of power, as shown in FIG. 10C.

As has been described above, according to the encoding method and apparatus, decoding method and apparatus of the present invention, the power compensation spectrums PCSP and the spectrums SP are composited. Thus, even though compression ratio is enhanced, abnormal sound and noise due to temporal band variation as well as lack of power can be significantly reduced, consequently improving auditory quality.

The invention is not limited to above-described embodiments, but various modifications, alternative constructions or equivalents can be implemented without departing from the scope and spirit of the present invention.

For example, above-described embodiments are explained using hardware configuration. On the other hand, the present invention is not limited the configuration, and arbitrary processing may be carried out by a CPU (Central Processing Unit) using a computer program. In this case, the computer program may be provided using a recording medium, or may be provided through the internet or other transmission media.

While the invention has been described in accordance with certain preferred embodiments thereof illustrated in the accompanying drawings and described in the above description in detail, it should be understood by those ordinarily skilled in the art that the invention is not limited to the embodiments, but various modifications, alternative constructions or equivalents can be implemented without departing from the scope and spirit of the present invention as set forth and defined by the appended claims.

INDUSTRIAL APPLICABILITY

As in the above, according to the present invention, the encoding side generates power adjustment information to adjust power of power compensation spectrums, which are to be composited with spectrums at decoding side, and encodes the power adjustment information together with the spectrums. The decoding side adjusts power of the power compensation spectrums using the power adjustment information, and composites the power-adjusted power compensation spectrums with the spectrums. Thus, even though compression ratio is enhanced, abnormal sound and noise due to temporal band variation as well as lack of power can be significantly reduced, consequently improving auditory quality.

The invention claimed is:

1. An encoding method for encoding spectrums that are generated from an input digital signal through spectrum conversion, comprising:

a power adjustment information generation step of generating power adjustment information to adjust power of each one of power compensation spectrums which are composited with the spectrums at decoding side; and an encoding step of encoding the power adjustment information together with the spectrums, wherein, the power of each one of power compensation spectrums is adjusted based on a normalization coefficient of the spectrums, quantization accuracy information of the spectrums and power adjustment information of the spectrums.

2. The encoding method as set forth in claim 1, wherein, in the power adjustment information generation step, the power adjustment information is generated based on tonality of the input digital signal.

3. The encoding method as set forth in claim 2, wherein, in the power adjustment information generation step, the power adjustment information is generated so that power compensation amount by the power compensation spectrums is small in case tonality of the input digital signal is higher than a predetermined threshold.

4. The encoding method as set forth in claim 1, wherein the power adjustment information indicates power control amount of the spectrums at decoding side.

5. The encoding method as set forth in claim 1, wherein, in the power adjustment information generation step, the power adjustment information is generated in respective units that are formed by dividing the spectrums by a predetermined number, or in respective groups that are formed by putting together a plurality of the units.

6. The encoding method as set forth in claim 1, wherein, in the power adjustment information generation step, the power adjustment information is generated for only spectrums of bands that are higher than a predetermined band.

7. An encoding apparatus for encoding spectrums that are generated from an input digital signal through spectrum conversion, comprising:

a power adjustment information generation unit for generating power adjustment information to adjust power of power compensation spectrums which are composited with the spectrums at decoding side;

an encoding unit for encoding the power adjustment information together with the spectrums, wherein, the power of each one of power compensation spectrums is adjusted based on a normalization coefficient of the spectrums, quantization accuracy information of the spectrums and power adjustment information of the spectrums.

8. The encoding apparatus as set forth in claim 7, wherein the power adjustment information generation unit generates the power adjustment information based on tonality of the input digital signal.

9. The encoding apparatus as set forth in claim 8, wherein the power adjustment information generation unit generates the power adjustment information so that power compensation amount by the power compensation spectrums is small in case tonality of the input digital signal is higher than a predetermined threshold.

10. The encoding apparatus as set forth in claim 7, wherein the power adjustment information indicates power control amount of the spectrums at decoding side.

11. The encoding apparatus as set forth in claim 7, wherein the power adjustment information generation unit generates the power adjustment information in respective units that are formed by dividing the spectrums by a predetermined number, or in respective groups that are formed by putting together a plurality of the units.

12. The encoding apparatus as set forth in claim 7, wherein the power adjustment information generation unit generates the power adjustment information for only spectrums of bands that are higher than a predetermined band.

13. A program for making a computer carry out an encoding processing of encoding spectrums that are generated from an input digital signal through spectrum conversion, comprising:

a power adjustment information generation step of generating power adjustment information to adjust power of power compensation spectrums which are composited with the spectrums at decoding side; and an encoding step of encoding the power adjustment information together with the spectrums, wherein, the power of each one of power compensation spectrums is adjusted based on a normalization coefficient of the spectrums, quantization accuracy information of the spectrums and power adjustment information of the spectrums.

14. A recording medium having recorded therein a program which can be read out by a computer, the program making a computer carry out an encoding processing of encoding spectrums that are generated from an input digital signal through spectrum conversion, comprising:

a power adjustment information generation step of generating power adjustment information to adjust power of power compensation spectrums which are composited with the spectrums at decoding side; and an encoding step of encoding the power adjustment information together with the spectrums, wherein, the power of each one of power compensation spectrums is adjusted based on a normalization coefficient of the spectrums, quantization accuracy information of the spectrums and power adjustment information of the spectrums.

15. A decoding method for decoding spectrums that are generated from a digital signal through spectrum conversion and encoding, comprising:

a decoding step of decoding the spectrums;

a power compensation spectrum generation step of generating power compensation spectrums;

a power adjustment step of adjusting power of the power compensation spectrums; and a composition step of compositing the decoded spectrums and the power-adjusted power compensation spectrums, wherein, the power of each one of power compensation spectrums is adjusted based on a normalization coefficient of the spectrums, quantization accuracy information of the spectrums and power adjustment information of the spectrums.

16. The decoding method as set forth in claim 15, wherein, in the power compensation spectrum generation step, the power compensation spectrums are generated by referencing values of a table that are generated from a predetermined spectrum pattern.

17. The decoding method as set forth in claim 16, wherein, in the power compensation spectrum generation step, the point to reference values of the table are determined based on data that is used in encoding the spectrums.

18. The decoding method as set forth in claim 17, wherein the data used in encoding the spectrums is the normalization coefficient.

19. The decoding method as set forth in claim 17, wherein the data used in encoding the spectrums is the quantization accuracy information.

20. The decoding method as set forth in claim 15, wherein, in the power compensation spectrum generation step, the power compensation spectrums are generated using a sequence of random numbers.

21. The decoding method as set forth in claim 20, wherein the sequence of random numbers is of Gaussian distribution.

22. The decoding method as set forth in claim 15, wherein, the normalization coefficient is used in decoding the spectrums.

23. The decoding method as set forth in claim 15, wherein, the quantization accuracy information is used in decoding the spectrums.

24. The decoding method as set forth in claim 15, wherein, in the power adjustment step, power of the power compensation spectrums is adjusted based on power adjustment information that has been encoded in encoding the spectrums.

25. The decoding method as set forth in claim 15, wherein, in the composition step, the spectrums and the power compensation spectrums are added.

26. The decoding method as set forth in claim 15, wherein, in the composition step, at least a part of the spectrums are replaced with the power compensation spectrums.

27. The decoding method as set forth in claim 15, wherein, in the composition step, spectrums having values that are equal to or smaller than a predetermined value and the power compensation spectrums are composited.

28. A decoding apparatus for decoding spectrums that are generated from a digital signal through spectrum conversion and encoding, comprising:

a decoding unit for decoding the spectrums;

a power compensation spectrum generation unit for generating power compensation spectrums;

a power adjustment unit for adjusting power of power compensation spectrums; and a composition unit for compositing the decoded spectrums and the power-adjusted power compensation spectrums, wherein, the power of each one of power compensation spectrums is adjusted based on a normalization coefficient of the spectrums, quantization accuracy information of the spectrums and power adjustment information of the spectrums.

29. The decoding apparatus as set forth in claim 28, wherein the power compensation spectrum generation unit generates the power compensation spectrums by referencing values of a table that is are generated from a predetermined spectrum pattern.

30. The decoding apparatus as set forth in claim 29, wherein the power compensation spectrum generation unit determines the point to reference values of the table based on data that is used in encoding the spectrums.

31. The decoding apparatus as set forth in claim 30, wherein the data used in encoding the spectrums is the normalization coefficient.

32. The decoding apparatus as set forth in claim 30, wherein the data used in encoding the spectrums is the quantization accuracy information.

33. The decoding apparatus as set forth in claim 28, wherein the power compensation spectrum generation unit generates the power compensation spectrums using a sequence of random numbers.

34. The decoding apparatus as set forth in claim 33, wherein the sequence of random numbers is of Gaussian distribution.

35. The decoding apparatus as set forth in claim 28, wherein the a normalization coefficient is used in decoding the spectrums.

36. The decoding apparatus as set forth in claim 28, wherein the quantization accuracy information is used in decoding the spectrums.

37. The decoding apparatus as set forth in claim 28, wherein the power adjustment unit adjusts power of the power compensation spectrums based on power adjustment information that has been encoded in encoding the spectrums.

38. The decoding apparatus as set forth in claim 28, wherein the composition unit adds the spectrums and the power compensation spectrums.

39. The decoding apparatus as set forth in claim 28, wherein the composition unit replaces at least a part of the spectrums with the power compensation spectrums.

40. The decoding apparatus as set forth in claim 28, wherein the composition unit composites spectrums having values that are equal to or smaller than a predetermined value and the power compensation spectrums.

41. A program for making a computer carry out a decoding processing of decoding spectrums that are generated from a digital signal through spectrum conversion and encoding, comprising:

a decoding step of decoding the spectrums;

a power compensation spectrum generation step of generating power compensation spectrums;

a power adjustment step of adjusting power of the power compensation spectrums; and a composition step of compositing the decoded spectrums and the power-adjusted power compensation spectrums, wherein, the power of each one of power compensation spectrums is adjusted based on a normalization coefficient of the spectrums, quantization accuracy information of the spectrums and power adjustment information of the spectrums.

42. A recording medium having recorded therein a program which can be read out by a computer, the program making a computer carry out a decoding processing of decoding spectrums that are generated from a digital signal through spectrum conversion and encoding, comprising:

a decoding step of decoding the spectrums;

a power compensation spectrum generation step of generating power compensation spectrums;

a power adjustment step of adjusting power of the power compensation spectrums; and a composition step of compositing the decoded spectrums and the power-adjusted power compensation spectrums, wherein, the power of each one of power compensation spectrums is adjusted based on a normalization coefficient of the spectrums, quantization accuracy information of the spectrums and power adjustment information of the spectrums.

* * * * *